US007096765B1

(12) United States Patent
Diggle, III et al.

(10) Patent No.: US 7,096,765 B1
(45) Date of Patent: Aug. 29, 2006

(54) MULTI-PURPOSE HAND TOOL AND INTERCONNECTED SET OF TOOLS

(75) Inventors: Frederick James Diggle, III, Birmingham, AL (US); Kenneth Newton, Jr., Southside, AL (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 10/668,091

(22) Filed: Sep. 19, 2003

(51) Int. Cl.
*B25B 13/06* (2006.01)

(52) U.S. Cl. ..... 81/124.4; 81/124.7; 81/125.1

(58) Field of Classification Search ..... 81/436–439, 81/461, 177.5, 121.1, 125.1, 124.7, 124.3, 81/124.2, 124.4
See application file for complete search history.

(56) References Cited

U.S. PATENT DOCUMENTS 4,357,845 A * 11/1982 Cornia ..... 81/125
4,399,723 A * 8/1983 Marleau ..... 81/437
4,620,460 A * 11/1986 Gonzales, Jr. ..... 81/124.4
4,887,498 A 12/1989 Zayat
4,947,713 A * 8/1990 Arnold ..... 81/121.1
5,086,674 A * 2/1992 Her ..... 81/124.4
5,216,940 A * 6/1993 Hedden ..... 81/177.2
5,460,064 A 10/1995 Zayat, Jr.
5,622,090 A 4/1997 Marks
D385,762 S 11/1997 Marks
5,791,209 A 8/1998 Marks
6,085,619 A 7/2000 Blake et al.
6,269,717 B1 * 8/2001 Bollinger ..... 81/177.2

OTHER PUBLICATIONS

U.S. Appl. No. 10/666,498, filed Sep. 19, 2003.

* cited by examiner

*Primary Examiner*—Debra S Meislin
(74) *Attorney, Agent, or Firm*—Lee & Hayes, PLLC

(57) ABSTRACT

A multi-purpose hand tool is disclosed. According to one embodiment, the tool may include a socket body, a key tip and an arm portion. The socket body may include a socket at a first end. The arm portion is connected between the socket body and the key tip. The key tip may include a hex key. The arm portion may define an opening for receiving a torquing device and the key tip may define a notch for receiving a torquing device.

6 Claims, 3 Drawing Sheets

MULTI-PURPOSE HAND TOOL AND INTERCONNECTED SET OF TOOLS

BACKGROUND

The present invention is directed generally to various embodiments of a multi-purpose hand tool.

To service and upgrade telecommunications infrastructure, the various telephone service providers in the United States alone employ approximately 200,000 service technicians. Among other things, these technicians are required to access and enter serving terminals, cross-boxes, subscriber loop connection (SLC) cabinets, etc. Each of these cabinets/boxes typically has a different type of locking mechanism, requiring the service technician to carry as part of his everyday-gear a multitude of different tools.

For example, service technicians typically enter cabinets with a combination of passkeys, hex keys and sockets. For example, to open a SLC cabinet the service technician must typically use two separate tools—both a hex key and a 7/16" socket. The socket may be part of a tubular, double-ended seven-inch tool called a "terminal wrench." The terminal wrench typically has the 7/16" socket on one end, which is also used to lock and unlock cross-boxes, plastic covers on some elevated serving terminal and pedestals. The other end of the terminal wrench typically has a 3/8" socket used to torque protectors and ground wire bolts in ONIs (outside network interface) in addition to tightening and loosening binding posts.

The diameter of conventional terminal wrenches, however, is so small that it is difficult for technicians to apply sufficient torque to properly lock cross-boxes, for example. This drawback is especially troublesome if the locking bolt on the cross-box seizes due to, for example, temperature changes. The result is that the service technicians are often careful not to lock cross-boxes too tightly for fear of having trouble opening it later. This can be a potential security threat as loose locking bolts are less likely to deter mischief.

Further, conventional terminal wrenches have unnecessary mass and size, making them cumbersome for service technicians to constantly carry, especially when one considers that service technicians are often required to climb telephone poles and otherwise exhibit nimbleness in servicing hard-to-reach equipment.

SUMMARY

In one general respect, the present invention is directed in various embodiments to a multi-purpose hand tool. Embodiments of the tool may include a socket body, a key tip and an arm portion. The socket body may include a socket at a first end. The arm portion is connected between the socket body and the key tip. The key tip may include a hex key. The arm portion may define an opening for receiving a torquing device and the key tip may define a notch for receiving a torquing device.

An embodiment of the tool may replace the combination of the hex wrench and the terminal wrench currently used in most cases to open SLC cabinets, thus replacing two tools with one that is more compact and weighs less. That is, the combination of the socket (such as a 7/16" socket) and the key tip could be used to open a SLC cabinet. No other implement would be needed in most cases to access these devices. Second, the openings for the torquing devices may provide the technician with greater torque control than exists with convention terminal wrenches. Third, the tool, in comparison with a conventional terminal wrench, may provide an additional function, namely torquing female fasteners with the key shaft arm.

In another general respect, the present invention is directed in various embodiments to a set of tools. The set of tools may include a first tool and a second tool that are removably interconnected. Each tool may include a socket body and a key tip with an arm portion therebetween. The key tip and arm portion of the second tool may extend into the socket of the socket body of the first tool.

Other variations and adaptations of the tool will be or become apparent to one of skill in the art upon review of the following drawings and detailed description. It is intended that all such additional variations and adaptations be included with this description, be within the scope of the present invention, and be protected by the accompanying claims.

DESCRIPTION OF THE DRAWINGS

Embodiments of the present invention will be described in conjunction with the following figures, which are not drawn to scale, wherein.

DESCRIPTION

Figure 3:
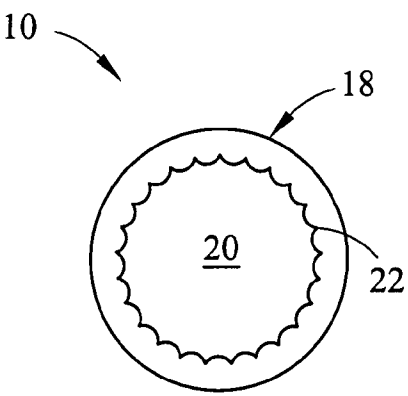
FIGS. 1–4 illustrate various embodiments of the tool.
Figure 2:
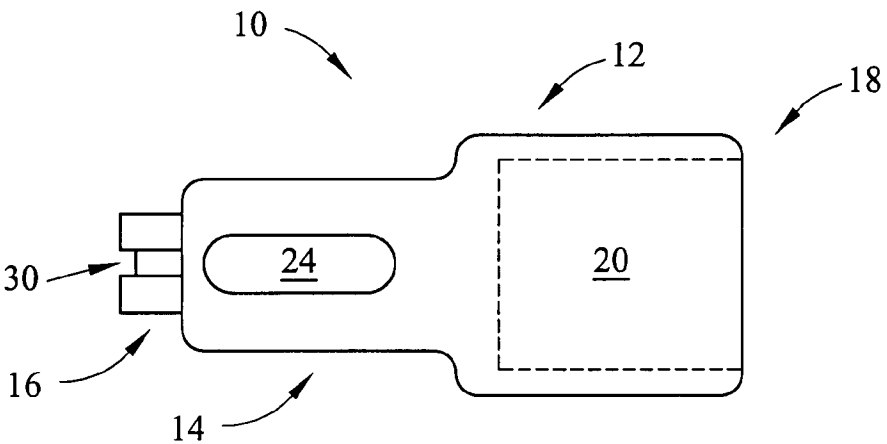
Figure 1:
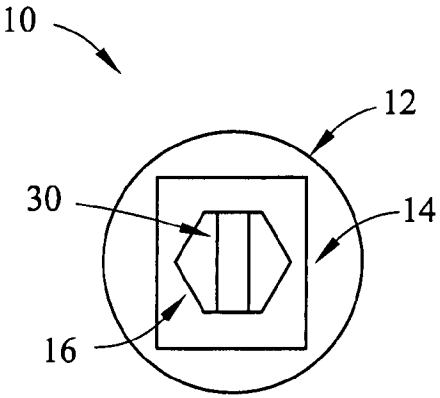

FIGS. 1–3 illustrate a multi-purpose hand tool 10 according to various embodiments of the present invention. FIG. 1 is a front view of the tool 10; FIG. 2 is a side view of the tool 10; and FIG. 3 is a back view of the tool 10. As can been seen in FIGS. 1–3, the tool 10 may include a socket body 12, an arm portion 14 and a key tip 16. As described in more detail below, the socket body 12 may include a socket 18 for tightening or loosening fasteners (e.g., screws, nuts or bolts) sized to fit within the socket 18. In addition, the key tip 16 may be used to tighten or loosen female fasteners (e.g., screws or bolts with openings sized to receive the key tip 16).

The socket body 12, the arm portion 14 and the key tip 16 may be constructed of any material suitable for the intended purpose, including such materials as metals, metal alloys, steel and/or steel alloys. According to one embodiment, the tool 10 may be made of carbide steel. In addition, the tool 10 may be formed by forging metal, such as drop forging, press forging, roll forging or cold forging.

Figure 4:
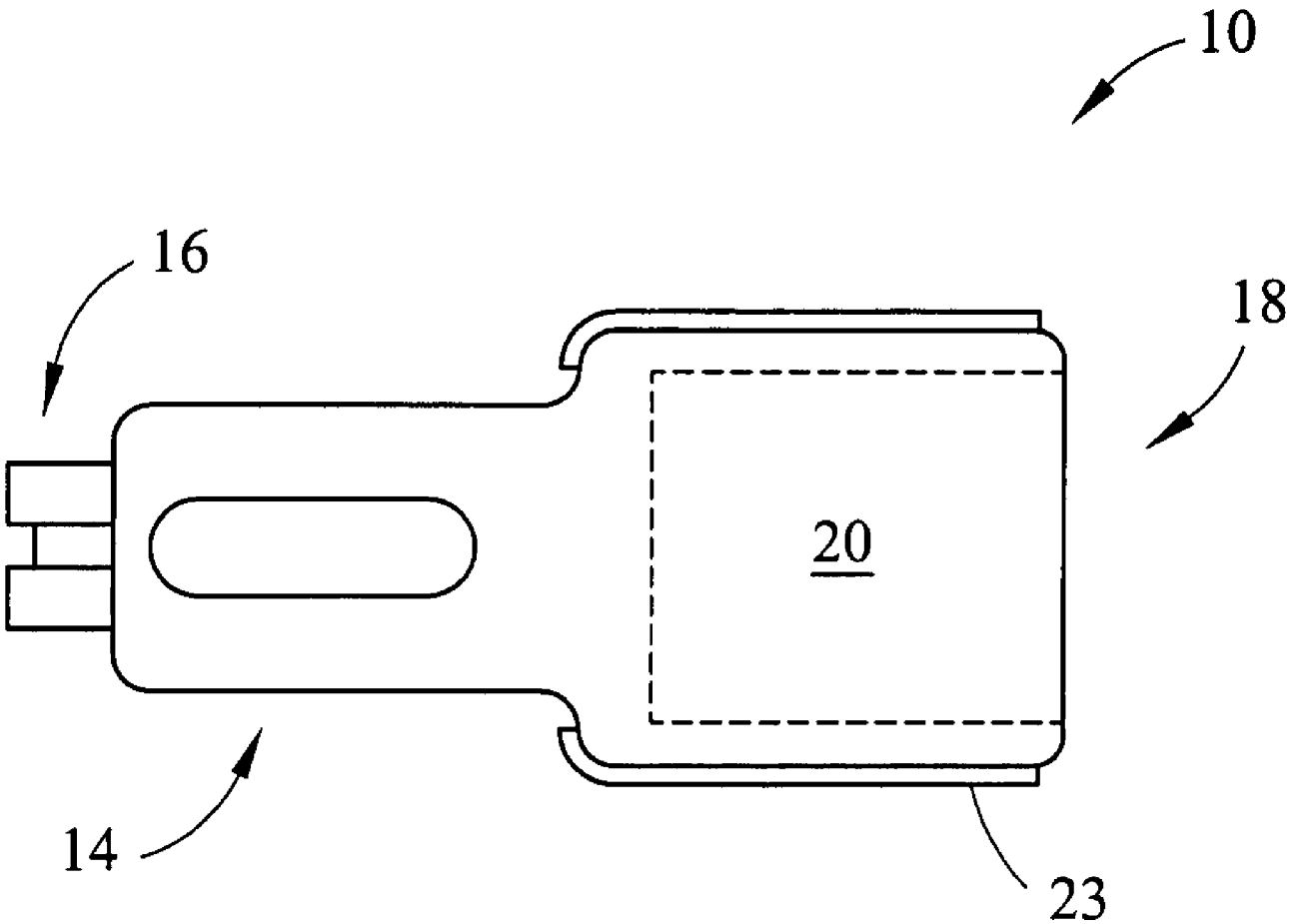

The socket body 12 may be, for example, cylindrical, as illustrated in FIGS. 1 and 3, although according to other embodiments, the socket body may be poly-sided. The socket 18 of the socket body 12 may define an opening 20 and may include a plurality of protruding teeth 22 for engaging a screw, bolt, nut or other type of fastener to be turned by the socket 18. The opening 20 may be deep enough, in the longitudinal direction, to receive the fastener and, as described in more detail below, may be deep enough to receive the key tip and arm portion of a second, similar tool. The teeth 22 may extend as far into the opening 20 as is necessary for the intended purpose, such as the depth to which the fastener extends into the opening 20. According to various embodiments, the socket 18 may be, for example, a 7/16" socket or a 3/8" socket. In addition, according to various embodiments, the socket body 12 may include a plastic sheathing 23, as shown in FIG. 4, around the outside of the socket body 12.

The arm portion 14 may be a protrusion extending away from the socket body 12 along the longitudinal axis of the socket body 12. In addition, as can be seen in FIG. 2, the arm portion 14 may be on the opposite side of the socket body 12 as the socket 18. The arm portion 14 may be multi-sided, thereby allowing a user of the tool 10 to grip the arm portion 14 with, for example, pliers or a wrench, to torque the tool 10. For example, a user could grip the arm portion 14 with pliers or a wrench to rotate the tool 10 in the roll direction to apply additional torque when using either the socket 18 or the key tip 16 to tighten or loosen fasteners. In FIG. 1, the arm portion 14 is shown as having a square-shaped cross-section, although according to various embodiments the arm portion 14 may assume other poly-sided shapes, such as a rectangle, a pentagon, a hexagon, etc. Further, as illustrated in FIG. 2, the arm portion 14 may define an opening 24 extending partially or completely through the arm portion 14. The arm portion 14 may allow a user to gain additional torque when rotating the tool 10 in the roll direction by inserting a torque arm device, such as, for example, a flat blade screwdriver or a jaw of a needle-nose pliers, into the opening 24 and rotating the torque arm device.

The key tip 16 may be for turning female fasteners, such as bolts or screws having a corresponding opening for receiving the key tip 16. According to one embodiment, the key tip 16 may be, for example, a hex key with six sides, as shown in FIG. 1. In addition, as shown in FIGS. 1 and 2, the key tip 16 may define a notch 30. The notch 30 may be sized to allow a user of the tool 10 to insert a torque arm device, such as, for example, a flat blade screwdriver, so as to allow the user to apply additional torque to the tool 10 when using the socket 18 by rotating the torque arm device inserted into the notch 30 of the key tip 16 in a roll direction.

The tool 10 may be sized for convenient usage by the user. According to various embodiments, the socket body 12 may be, for example, ½" to 2" in length and ½" to 2" in diameter. The arm portion 14 may also be, for example, ½" to 2" in length with a circumference less than that of the socket body 12. The key tip 16, for example, may have a length of ⅛" to ½", with a circumference less than that of the arm portion 14. In operation, the user may turn a fastener with the socket 18 by placing the socket 18 over the fastener and torquing the tool 10 by turning the tool 10 in a roll direction. As explained previously, additional torque may be applied to the fastener by using a torque arm device inserted into the opening 24 in the arm portion 14 or into the notch 30 in the key tip 16. In another mode of operation, the user may place the key tip 16 in a correspondingly shaped opening of a female fastener (e.g., screw or bolt) and torquing the tool 10 by turning the tool 10 in the roll direction. Again, additional torque may be applied by using a torque arm device inserted into the opening 24 in the arm portion 14.

Figure 5:
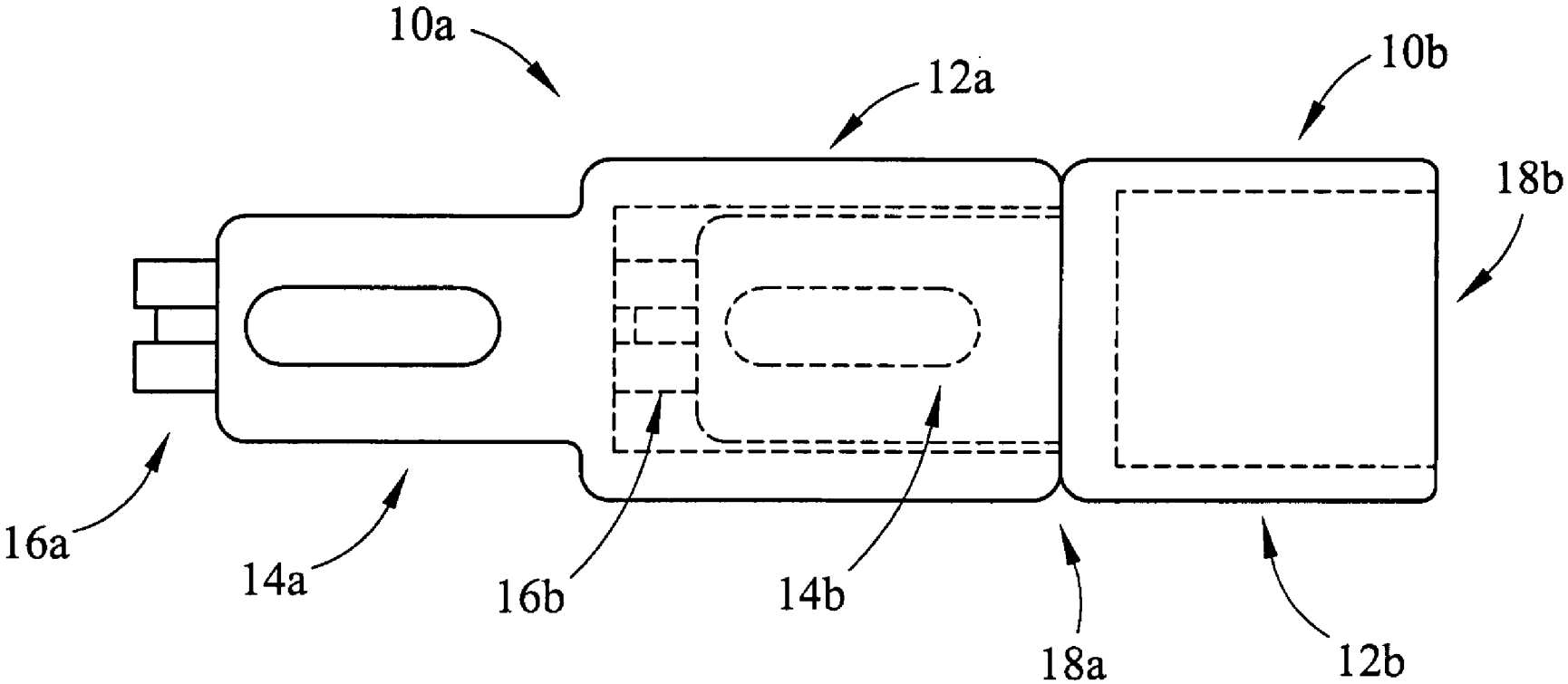
FIG. 5 is a side view of two interconnected tools according to various embodiments.

FIG. 5 is a side view of two removably interconnected tools 10*a*, 10*b*. As can been seen in FIG. 5, the key tip 16*b* and the arm portion 16*b* of the second tool 10*b* may fit within the opening 20 of the first tool 10*a*. The fit may be sufficiently snug such that the user must twist or pull the second tool 10*b* to remove it from the first tool 10*a*. Further, the sockets 18*a*, 18*b* of the tools 10*a*, 10*b*, respectively, may be differently sized. For example, the socket 18*a* of the tool 10*a* may be a 7⁄16" socket and the socket 18*b* of the tool 10*b* may be a ⅜" socket. Further, the key tips 16*a*, 16*b* of the respective tools 10*a*, 10*b* may be differently sized. For example, the key tip 16*a* may have a greater circumference than the key tip 16*b*. In this fashion, a user of the tools 10*a*, 10*b* could conveniently carry two tools 10*a*, 10*b* with different dimensions.

Embodiments of the tool 10 may be suited for telecommunication service technicians in that the tool 10 may, for example, solve or mitigate many problems experienced by telephone service technicians. For example, an embodiment of the tool 10 may replace the combination of the hex wrench and the terminal wrench currently used in many cases to open SLC cabinets, thus replacing two tools with one that is more compact and weighs less. That is, the combination of the socket 18 (such as a 7⁄16" socket) and the key tip 16 could be used to open a SLC cabinet. No other implement would be needed in many cases to access these devices. Further, the socket 18*b* of a second tool 10*b* (such as a ⅜" socket) could be used, for example, to tighten or loosen binding posts. Second, the opening 24 and/or the notch 30 may provide the technician with greater torque control than exists with convention terminal wrenches. Third, the tool 10, in comparison with a conventional terminal wrench, may provide an additional function, namely torquing female fasteners with the key tip 16.

What is claimed is:

1. A multi-purpose hand tool, comprising:

a socket body having a socket at a first end, wherein the socket defines an opening for receiving a second tool;

a plastic sheathing around the socket body;

a hex key tip; and an arm portion connected between a second end of the socket body and the key tip, wherein the arm portion defines an opening to receive a torque arm device, wherein the opening extends partially through the arm portion, wherein the socket body, the key tip, and the arm portion are of one piece, unitary construction, wherein the key tip defines a notch in an end of the key tip opposite the arm portion, and wherein the socket body, the key tip, and the arm portion include a material selected from the group consisting of metal, metal alloys, steel and steel alloys.

2. A multi-purpose hand tool, comprising:

means for torquing a first female fastener, wherein the means for torquing includes a key tip that further includes a hex key;

means for socket wrenching a second fastener, wherein the means for socket wrenching includes a socket body having a socket;

a plastic sheathing around the socket body;

an arm portion connected between the means for torquing and the means for socket wrenching, wherein the arm portion defines an opening to receive a torque arm device, wherein the opening extends partially through the arm portion, and wherein the arm portion is multi-sided;

wherein the key tip defines a notch in an end of the key tip opposite the arm portion;

wherein the means for torquing, the means for socket wrenching, and the arm portion are of one piece, unitary construction, and wherein the means for torquing, the means for socket wrenching, and the arm portion include a material selected from the group consisting of metal, metal alloys, steel and steel alloys.

3. A set of tools, comprising:

a first tool including a first socket body having a first socket, a first hex key tip, and a first arm portion connected between the first socket body and the first key tip, wherein the first arm portion includes a torque arm opening to receive a torque arm device, and wherein the first socket body defines a first opening, wherein the first tool includes a plastic sheathing around the first socket body, and wherein the first key tip defines a first notch in an end of the first key tip opposite the first arm portion; and at least a second tool including a second socket body having a second socket, a second hex key tip, and a second arm portion connected between the second socket body and the second key tip, wherein the second socket body defines a second opening, wherein the second tool includes a plastic sheathing around the second socket body, and wherein the second key tip defines a second notch in an end of the second key tip opposite the second arm portion, wherein the second key tip and the second arm portion extend into the first opening;

wherein the first socket body, the first key tip, and the first arm portion of the first tool are of one piece, unitary construction, wherein the first socket body, the first key tip, and the first arm portion of the first tool include a material selected from the group consisting of metal, metal alloys, steel and steel alloys;

wherein the second socket body, the second key tip, and the second arm portion of the second tool are of one piece, unitary construction; and wherein the second socket body, the second key tip, and the second arm portion of the second tool include a material selected from the group consisting of metal, metal alloys, steel and steel alloys; and wherein the second tool is removably nested within the first tool, and further wherein the torque arm opening of the first arm portion remains accessible to receive the torque arm device.

4. The set of tools of claim 3, wherein:

the second socket of the second tool defines a second opening; and the size of the first opening of the first tool does not equal the size of the second opening of the second tool.

5. The set of tools of claim 4, wherein a circumference of the first key tip of the first tool does not equal a circumference of the second key tip of the second tool.

6. The set of tools of claim 5, wherein:

the torque arm opening extends partially through the first arm portion.

* * * * *